US006962000B2

(12) United States Patent
Teeuw et al.

(10) Patent No.: US 6,962,000 B2
(45) Date of Patent: Nov. 8, 2005

(54) CUTTING MEMBER WITH DUAL PROFILE TIP

(75) Inventors: Dirk Herbert Johan Teeuw, Drachten (NL); Ype Bernardus Brada, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 86 days.

(21) Appl. No.: 10/483,025

(22) PCT Filed: Jun. 24, 2002

(86) PCT No.: PCT/IB02/02512

§ 371 (c)(1),
(2), (4) Date: Jan. 6, 2004

(87) PCT Pub. No.: WO03/006218

PCT Pub. Date: Jan. 23, 2003

(65) Prior Publication Data

US 2004/0177516 A1 Sep. 16, 2004

(30) Foreign Application Priority Data

Jul. 11, 2001 (EP) ..... 01202663

(51) Int. Cl.[7] ..... B26B 21/56; B26B 21/60
(52) U.S. Cl. ..... 30/346.55; 30/346.5
(58) Field of Search ..... 30/346.5, 346.55, 30/346.53, 346.54

(56) References Cited

U.S. PATENT DOCUMENTS 4,720,918 A * 1/1988 Curry et al. ..... 30/346.55
4,933,058 A * 6/1990 Bache et al. ..... 204/192.3
5,232,568 A * 8/1993 Parent et al. ..... 204/192.3
5,669,144 A * 9/1997 Hahn et al. ..... 30/346.54
6,684,513 B1 * 2/2004 Clipstone et al. ..... 30/346.54

FOREIGN PATENT DOCUMENTS

EP 0591339 4/1994 ..... B26B 21/54
WO WO8402104 6/1984 ..... B26B 21/56

* cited by examiner

*Primary Examiner*—Hwei-Siu Payer

(57) ABSTRACT

The invention relates to a cutting member (7) includes a plate-shaped substrate (19) on which a tip (27) is provided which is bounded by a cutting edge (9). According to the invention, the tip includes an ultimate tip (31) and a basic tip (33), the ultimate tip extending from the cutting edge over a distance d1 and having a profile which at least approximates the equation $w=a\mathbf{1}.d^{n1}$, and the basic tip connecting to the ultimate tip and having a profile which at least approximates the equation $w=a.(d+R)^n$, where w is a profile thickness (in $\mu$m) and d is a distance (in $\mu$m) from the cutting edge (9), and n1 is smaller than n, and $a\mathbf{1}=a.(d\mathbf{1}+R)^n/d\mathbf{1}^{n1}$. In this manner, the profile of the ultimate tip is relatively robust and the profile of the basic tip is relatively slender, as a result of which the cutting member has a comparatively high resistance to wear, and the cutting forces of the cutting member are comparatively small.

Figure 1:
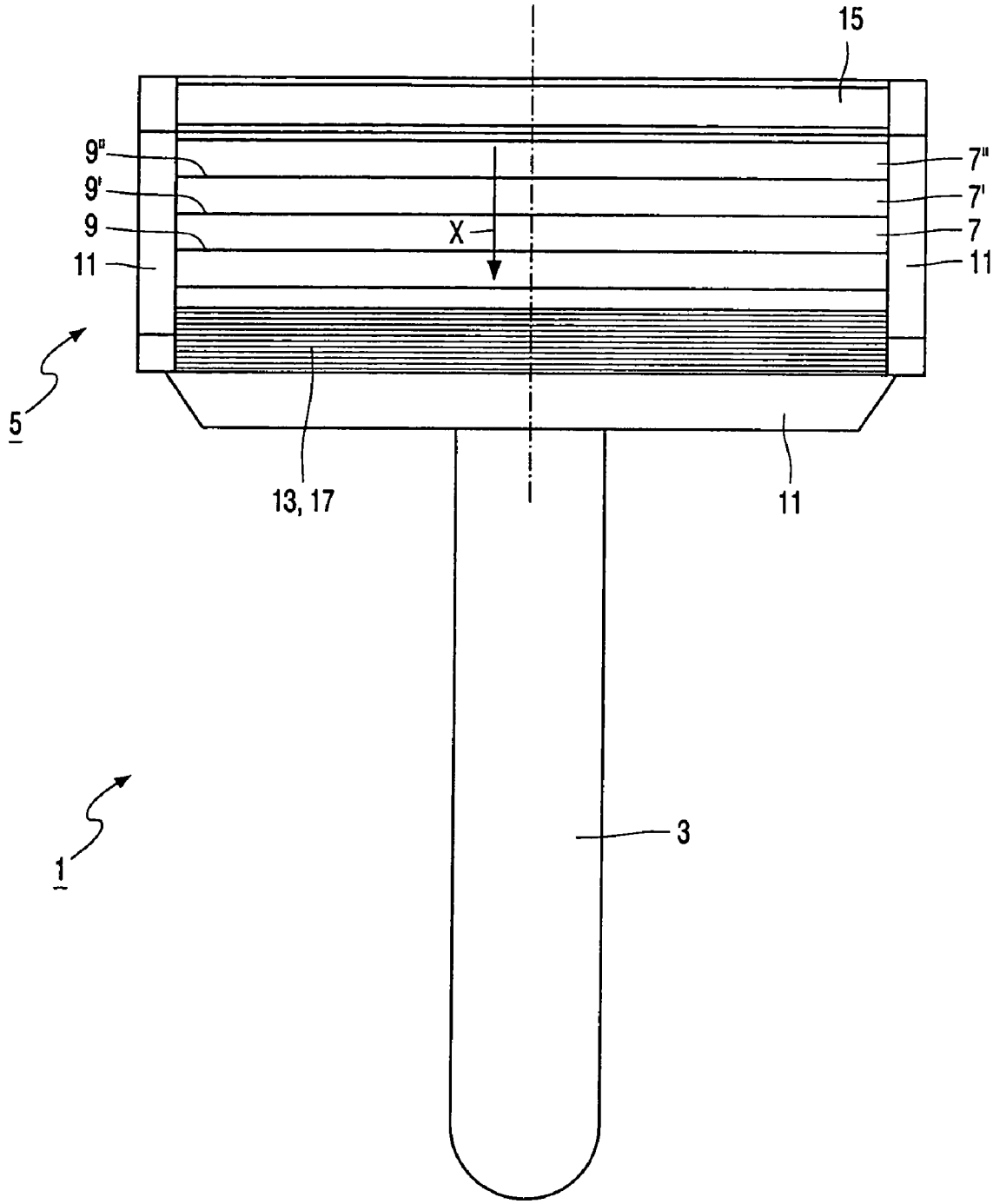

In one example, n1=n.d1/(R+d1), resulting in the basic tip (33) connecting to the ultimate tip (31) without a kink, so that the cutting forces are further reduced. In another example, the ultimate tip and the basic tip comprise a coating (35) made from a material, for example diamond-like carbon, having a higher modulus of elasticity than the material from which the substrate (19) is made.

11 Claims, 5 Drawing Sheets

CUTTING MEMBER WITH DUAL PROFILE TIP

The invention relates to a cutting member comprising a plate-shaped substrate on which a tip is provided which is bounded by a cutting edge, which tip, viewed in an imaginary plane extending perpendicularly to the cutting edge, has a profile that at least approximates the equation $w=a.d^n$, where w is a profile thickness (in $\mu$m), viewed in a direction perpendicular to a bisecting line of the tip, and d is a distance (in $\mu$m) up to the cutting edge, viewed in a direction parallel to the bisecting line, and a is smaller than approximately 0.8 and n is smaller than approximately 0.75 and greater than approximately 0.65.

The invention further relates to a shaving head comprising a holder wherein at least one cutting member is provided, which cutting member is provided with a plate-shaped substrate on which a tip is provided which is bounded by a cutting edge, which tip, viewed in an imaginary plane extending perpendicularly to the cutting edge, has a profile that approximates the equation $w=a.d^n$, where w is a profile thickness (in $\mu$m), viewed in a direction perpendicular to a bisecting line of the tip, and d is a distance (in $\mu$m) up to the cutting edge, viewed in a direction parallel to the bisecting line, and a is smaller than approximately 0.8 and n is smaller than approximately 0.75 and greater than approximately 0.65.

The invention also relates to a shaver comprising a housing or handgrip on which a shaving head is provided, which shaving head is provided with a holder accommodating at least one cutting member, which cutting member is provided with a plate-shaped substrate on which a tip is provided which is bounded by a cutting edge, which tip, viewed in an imaginary plane extending perpendicularly to the cutting edge, has a profile that at least approximates the equation $w=a.d^n$, where w is a profile thickness (in $\mu$m), viewed in a direction perpendicular to a bisecting line of the tip, and d is a distance (in $\mu$m) up to the cutting edge, viewed in a direction parallel to the bisecting line, and a is smaller than approximately 0.8 and n smaller than approximately 0.75 and greater than approximately 0.65.

A cutting member of the type mentioned in the opening paragraph is known from WO 84/02104. The known cutting member is a razor blade for use in a razor. The substrate of the razor blade is made of stainless steel. The tip is provided near one of the edges of the substrate by means of a grinding process, and said tip is provided with a comparatively thin coating of an alloy of chromium and platinum. The profile provided on the tip extends from the cutting edge over a distance of approximately 40 $\mu$m. As the values of a and n lie within the above-mentioned ranges, the profile of the tip on average is more robust than the profile that the tip would have if said tip was provided, over said distance, with two flat facets. As a result, the tip is comparatively strong, so that deformations of the tip, which occur under the influence of cutting forces and are an important cause of wear of the razor blade, are limited. The known razor blade consequently has a longer service life than a razor blade whose tip comprises two flat facets over said distance.

In the known cutting member, the values of a and n in the above-mentioned ranges result in a compromise between, on the one hand, the magnitude of the cutting forces and, on the other hand, the service life. A more robust profile, which is obtained at a higher value of a and/or a smaller value of n, would lead to less wear and a longer service life, but also to larger cutting forces, which adversely affect the shaving comfort. A more slender profile, which is obtained at a smaller value of a and/or a larger value of n, would lead to smaller cutting forces but also to an increase in wear and a shorter service life. Consequently, as a result of said compromise, the cutting forces, the shaving comfort and the service life of the known cutting member are sub-optimal.

It is an object of the invention to provide a cutting member, a shaving head and a shaver of the types mentioned in the opening paragraph, wherein wear of the cutting member is further reduced and the service life is further extended, while the cutting forces are at least equally small and the shaving comfort at least equally high as in the known cutting member.

To achieve this object, a cutting member in accordance with the invention is characterized in that the tip comprises an ultimate tip and a basic tip, which ultimate tip extends from the cutting edge over a distance d1 and has a profile that at least approximates the equation $w=a\mathbf{1}.d^{n1}$, while the basic tip connects to the ultimate tip and has a profile that at least approximates the equation $w=a.(d+R)^n$, where d1 is smaller than approximately 5 $\mu$m, R is smaller than approximately 0.5 $\mu$m, n1 is smaller than n, and $a\mathbf{1}=a.(d\mathbf{1}+R)^n/d\mathbf{1}^{n1}$.

To achieve this object, a shaving head in accordance with the invention is characterized in that the cutting member used therein is a cutting member in accordance with the invention.

To achieve this object, a shaver in accordance with the invention is characterized in that the shaving head used therein is a shaving head in accordance with the invention.

It has been found that during cutting a hair, the ultimate tip is used to split the hair into two parts at the location of the fracture face, while the basic tip is used to push the split parts further apart, thereby enabling the cutting member to further penetrate into the hair. It has been found that the cutting force experienced by the user when the hair is being cut is substantially determined by the force that is necessary to push the already split parts of the hair further apart. As the latter process is carried out predominantly by the basic tip, the profile of the basic tip has a much greater influence on the magnitude of the cutting forces than the profile of the ultimate tip. It has been found that wear on the tip occurs predominantly at the location of the ultimate tip. Since n1 is smaller than n, the profile of the ultimate tip is much more robust than the profile that the ultimate tip would have if the profile of the basic tip also extended over the ultimate tip. As a result, the ultimate tip is comparatively strong, so that said ultimate tip has a comparatively high resistance to wear. As wear on the tip occurs predominantly at the location of the ultimate tip, wear on the cutting member as a whole is limited substantially and the service life of the cutting member is increased substantially. The profile of the basic tip corresponds to the profile of the tip of the above-mentioned, known cutting member, so that the cutting forces of the cutting member in accordance with the invention, which are determined predominantly by the profile of the basic tip, are at least just as small, and the shaving comfort at least just as high, as in the known cutting member. Therefore, the cutting member in accordance with the invention comprises an ultimate tip with a comparatively robust profile and a basic tip with a comparatively slender profile. Since $a\mathbf{1}=a.(d\mathbf{1}+R)^n/d\mathbf{1}^{n1}$, the ultimate tip and the basic tip connect to each other at the location of d=d1. In the equation for the profile of the basic tip, R is the distance between the cutting edge and an imaginary cutting edge, situated in front of the cutting edge, which the tip would have if the profile of the basic tip extended also over the ultimate tip.

A particular embodiment of a cutting member in accordance with the invention is characterized in that n1=n.d1/

(R+d1). In this particular embodiment, the ultimate tip and the basic tip blend with each other, i.e. without a kink, at the location where d=d1. As a kink between the ultimate tip and the basic tip causes additional resistance during cutting a hair, the cutting forces of the cutting member are further reduced in this particular embodiment.

A further embodiment of a cutting member in accordance with the invention is characterized in that a1 is greater than approximately 0.8 and n1 is smaller than approximately 0.65. In this further embodiment, the robustness of the profile of the ultimate tip of the cutting member is further increased, so that the resistance to wear on the cutting member is further improved and the service life of the cutting member is further increased.

A still further embodiment of a cutting member in accordance with the invention is characterized in that d1 is smaller than approximately 1 $\mu$m. It has been found that splitting of the hairs at the location of the fracture face takes place predominantly by means of the part of the tip that is situated within a distance of approximately 1 $\mu$m from the cutting edge. Wear on the tip therefore occurs predominantly at the location of said part of the tip. As the ultimate tip with the comparatively robust profile extends, in this still further embodiment, exclusively in this part of the tip, the negative influence exerted by the comparatively robust profile on the cutting forces and the shaving comfort is further reduced.

A particular embodiment of a cutting member in accordance with the invention is characterized in that R is smaller than approximately 0.2 $\mu$m. The ultimate tip is preferably manufactured by providing the entire tip with the profile of the basic tip, and by providing the profile of the ultimate tip on the basic tip by means of etching. As R is the distance between the cutting edge and an imaginary cutting edge, situated in front of the cutting edge, which the tip would have if the profile of the basic tip extended also over the ultimate tip, R is the etching depth near the cutting edge, which is necessary to provide the profile of the ultimate tip in the profile of the basic tip. If R is smaller than approximately 0.2 $\mu$m, the profile of the ultimate tip is sufficiently robust in most cases, while the necessary depth of etching near the cutting edge is limited.

A further embodiment of a cutting member in accordance with the invention is characterized in that the ultimate tip and the basic tip are provided with a coating of a material having a higher modulus of elasticity than the material used to manufacture the substrate, with the coating having said profiles of the ultimate tip and the basic tip. As the coating has said profiles of the ultimate tip and the basic tip, the cutting member, in this further embodiment, also has a comparatively high resistance to wear, while the cutting forces are comparatively small. As the material of the coating has a comparatively high modulus of elasticity, the resistance to wear and the service life of the cutting member are further increased in this embodiment. In addition, in this embodiment, the profiles of the basic tip and the ultimate tip can be made more slender to further reduce the cutting forces, while preserving a comparatively long service life.

A still further embodiment of a cutting member in accordance with the invention is characterized in that, at the location where in the basic tip the substrate is present below the coating, the substrate has a basic profile that at least approximates the equation $w=a.(d+R)^n-2h$, where h is a thickness of the coating, and in that, at the location where in the ultimate tip the substrate is present below the coating, the substrate has a profile that is blunt in comparison with the basic profile. Said basic profile can be provided in a comparatively simple and accurate manner on the substrate by means of, for example, a grinding process. At the location of the basic tip, the coating can be provided with the desired profile in a comparatively simple and accurate manner by providing the coating in a substantially constant thickness h on the basic profile of the substrate. As the substrate has a profile which, at locations where in the ultimate tip the substrate is present below the coating, is blunt as compared to the basic profile, the substrate has a more robust profile, as does the coating, at the location of the ultimate tip, as a result of which the substrate satisfactorily supports the coating at the location of the ultimate tip.

A particular embodiment of a cutting member in accordance with the invention is characterized in that the material of the coating comprises DLC (diamond-like carbon). DLC has a very high modulus of elasticity, so that the cutting member in this embodiment has a very long service life. In addition, DLC has a low coefficient of friction, so that the cutting forces are further reduced. The coating of DLC can be provided in a comparatively simple and accurate manner on the substrate by means of a CVD or PVD process, and the profiles of the ultimate tip and the basic tip can be provided in a comparatively simple and accurate manner in the coating by means of an ion-sputter-etch process.

A further embodiment of a cutting member in accordance with the invention is characterized in that an intermediate layer comprising Cr is provided between the coating and the substrate. The presence of the intermediate layer of Cr causes the adhesion of the coating of DLC to the substrate to be substantially improved, as a result of which the service life of the cutting member is further extended.

These and other aspects of the invention are apparent from and will be elucidated with reference to the embodiment(s) described hereinafter.

Figure 2:
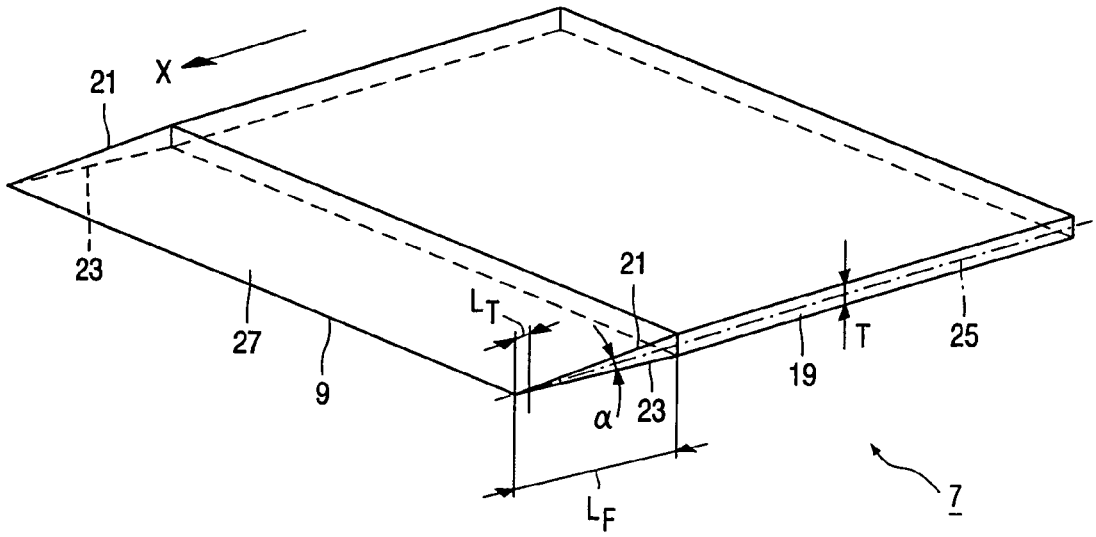
Figure 3:
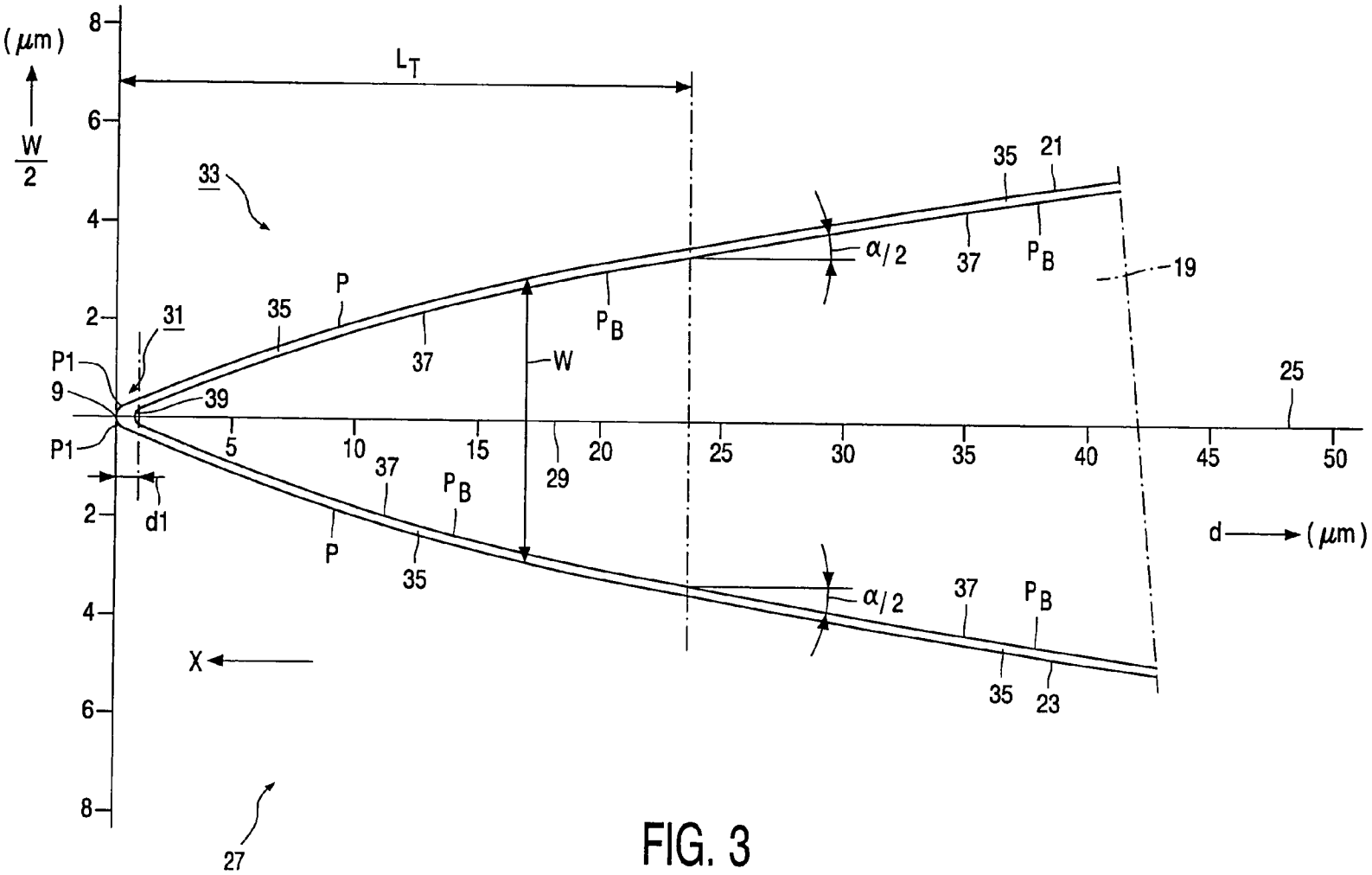
Figure 4:
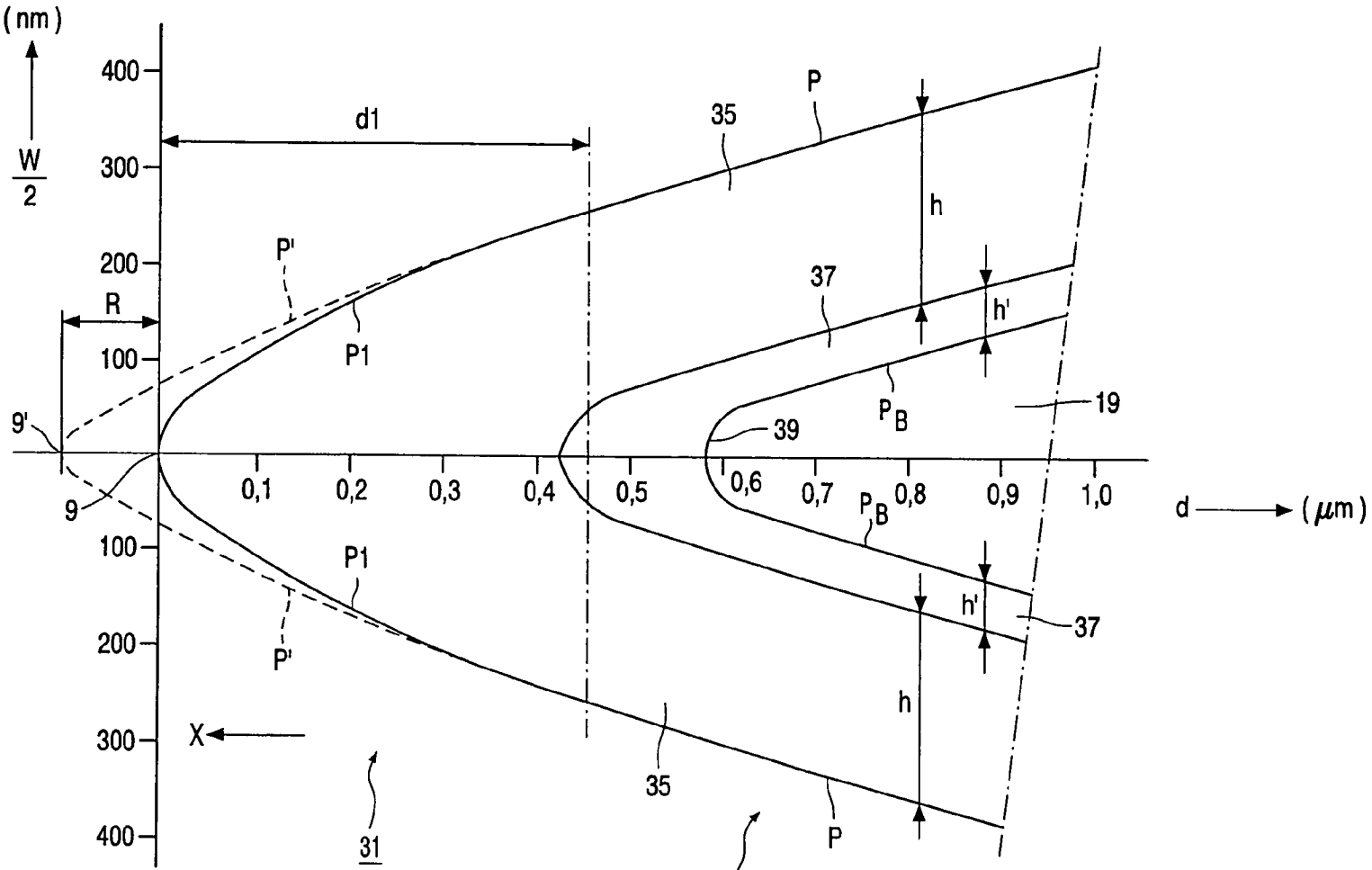
Figure 5:
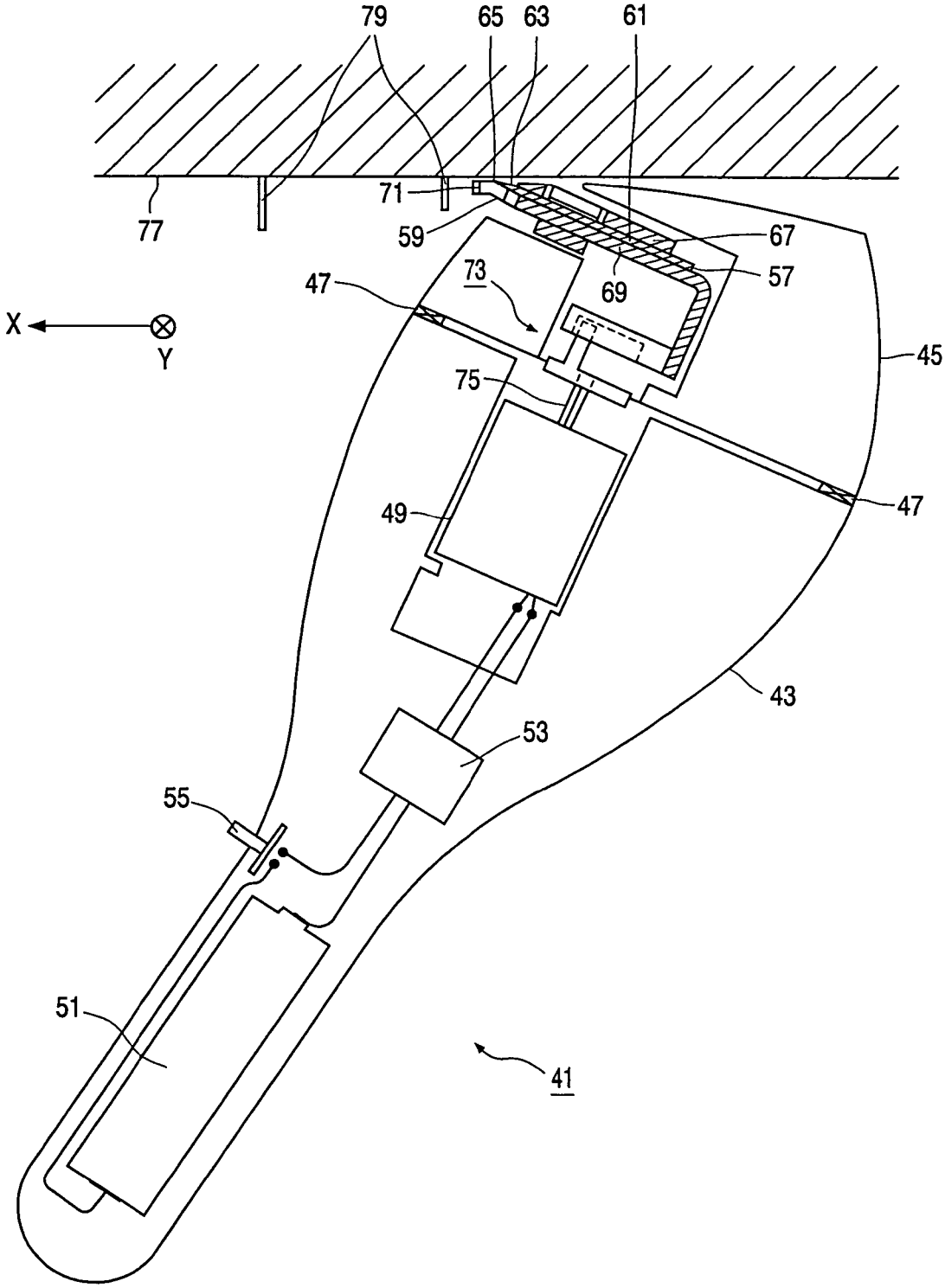

In the drawings:

FIG. 1 diagrammatically shows a first embodiment of a shaver in accordance with the invention, FIG. 2 diagrammatically shows a cutting member in accordance with the invention which is used in the shaver in accordance with FIG. 1, FIG. 3 is a diagrammatic, sectional view of a tip of the cutting member in accordance with FIG. 2, FIG. 4 is a diagrammatic, detailed view of an ultimate tip of the tip in accordance with FIG. 3, and FIG. 5 diagrammatically shows a second embodiment of a shaver in accordance with the invention.

FIG. 1 diagrammatically shows a first embodiment of a shaver 1 in accordance with the invention, which shaver is a manually operated razor provided with a handgrip 3 onto which a first embodiment of a shaving head 5 in accordance with the invention is detachably secured by means of a coupling mechanism that is not shown in the Figure. It is noted, however, that the invention also includes embodiments of such a razor wherein a shaving head in accordance with the invention is not detachably secured to a handgrip. The shaving head 5 comprises a first cutting member 7 in accordance with the invention that is provided with a straight cutting edge 9 that extends perpendicularly to a shaving direction X in which the shaving head 5 is to be moved over the skin, a second cutting member 7' in accordance with the invention that is also provided with a straight cutting edge 9' extending perpendicularly to the shaving direction X, which second cutting member is arranged behind the first cutting member 7, viewed in the shaving direction X, and a third cutting member 7" in accordance with the invention that is also provided with a straight cutting edge 9" extending perpendicularly to the shaving direction X, which third cutting member is arranged behind the second cutting member 7', viewed in the shaving direction X. The cutting members 7, 7' and 7" are each fitted in a holder 11 on which a first skin supporting element 13 is provided in front of the first cutting member 7 and a second skin supporting element 15 is provided behind the third cutting member 7", viewed in the shaving direction X. The first skin supporting element 13 is made of a type of rubber and has a surface 17 provided with grooves, so that the first skin supporting element 13 has a skin stretching effect when the shaving head 5 is moved in the shaving direction X. The two skin supporting elements 13 and 15 define a skin contact surface of the shaving head 5 with which the shaving head 5, in operation, lies against the skin to be shaved. In the example shown, the three cutting members 7, 7' and 7" are identical and arranged in identical positions relative to said skin contact surface. It is noted that the invention also includes embodiments of such a shaving head which are provided with a different number of cutting members or with cutting members having different dimensions or contours, or with cutting members which are each arranged in a different position, such as a different angle, with respect to the skin contact surface.

The cutting member 7 is diagrammatically shown in FIG. 2. The cutting member 7 comprises a plate-shaped steel substrate 19 which, in the example shown, has a thickness T of approximately 0.1 mm. On the side oriented in the shaving direction X, the substrate 19 is provided with two facet faces 21 and 23 by means of a grinding process, which, in the example shown, are flat for the greater part and symmetrically provided with respect to an imaginary center plane 25 of the substrate 19. The meeting ends of the two facet faces 21, 23 form a tip 27, which will be described in greater detail hereinafter, of the substrate 19, which tip is bounded by the cutting edge 9. The flat portions of the facet faces 21, 23 include, in the example shown, a wedge angle $\alpha$ of approximately 12°, so that the facet faces 21, 23 have a length $L_F$ of approximately 0.5 mm in the example shown. The tip 27 extends from the cutting edge 9 over a distance $L_T$ of approximately 24 $\mu$m in the example shown. FIG. 3 is a detailed sectional view of the tip 27 in an imaginary plane extending perpendicularly to the cutting edge 9. In said imaginary plane, the tip 27 has a curved profile, so that the tip 27 is more robust than a tip of the cutting member 7 would be if the facet faces 21, 23 were completely flat and connected to each other near the cutting edge 9 so as to include the wedge angle $\alpha$. The curved profile of the tip 27 approximates to a large extent the equation $w=a.d^n$, where w is a profile thickness (in $\mu$m), shown in FIG. 3, viewed in a direction perpendicular to a bisecting line 29 of the tip 27, and d is a distance (in $\mu$m) up to the cutting edge 9, viewed in a direction parallel to the bisecting line 29. In the example shown, a is approximately 0.78 and n is approximately 0.7. As the tip 27 has said profile, the tip 27 is comparatively strong, so that deformations of the tip 27, which develop during cutting hairs under the influence of cutting forces exerted on the tip 27 and which are an important cause of wear on the cutting member 7 under normal operating conditions, are limited, and hence the cutting member 7 has a comparatively long service life. It is noted that the invention also comprises embodiments wherein the values of a and n differ from the values mentioned in the above example. The invention comprises, in general, embodiments where the value of n is smaller than approximately 0.75 and greater than approximately 0.65, and where the value of a is smaller than approximately 0.8. If the values of a and n lie in said ranges, the profile of the tip 27 is neither too robust, which could lead to unacceptably large cutting forces, nor too slender, which could lead to excessive wear on the tip and too short a service life. The above-mentioned limiting values of said ranges, however, are coarse limiting values that can vary approximately 10%.

As mentioned hereinabove, the profile of the tip 27 approximates to a large extent the equation $w=a.d^n$. However, as shown in detail in FIG. 3, the tip 27 comprises an ultimate tip 31 extending from the cutting edge 9 over a distance d1, and a basic tip 33 which connects, at the distance d1 from the cutting edge 9, to the ultimate tip 31 and extends as far as said distance $L_T$ from the cutting edge 9. In the example shown, d1 is approximately 0.45 $\mu$m, i.e. approximately 0.02 $L_T$. FIG. 4 is a detailed sectional view of the ultimate tip 31 in the above-mentioned imaginary plane that extends perpendicularly to the cutting edge 9. In FIG. 4, dashed line P' indicates the imaginary profile that the ultimate tip 31 would have if the profile of the tip 27, indicated in FIG. 4 by means of P, entirely approximated the equation $w=a.d^n$. The actual profile of the ultimate tip 31, which is indicated in FIG. 4 by means of P1, is more robust, however, than the profile P', so that the cutting edge 9 is situated, viewed in the shaving direction X, behind an imaginary cutting edge 9' that the cutting member 7 would have if the ultimate tip 31 had the profile P'. The distance between the cutting edge 9 and the imaginary cutting edge 9' is indicated by means of R in FIG. 4, so that the profile P of the basic tip 33 approximates the equation $w=a.(d+R)^n$, where a and n have the values indicated hereinabove. In accordance with the invention, the profile P1 of the ultimate tip 31 approximates the equation $w=a1.d^{n1}$, where n1 is smaller than n, so that the profile P1 is more robust than the profile P', and $a1=a.(d1+R)^n/d1^{n1}$, so that the profiles P and P1 connect to each other at the location where d=d1. Experiments have shown that during cutting a hair, the ultimate tip 31 is used predominantly to make a first incision in the hair forming the beginning of a fracture face and to further split the hair into two parts at the location of the fracture face. The basic tip 33 is predominantly used to push the already split parts of the hair further apart behind the ultimate tip 31, so that the cutting member 7 is capable of penetrating further into the hair. Experiments have shown that the last-mentioned process predominantly determines the cutting force experienced by the user during cutting the hair, while the wear on the tip 27 under normal operating conditions occurs predominantly at the location of the ultimate tip 31. As the profile P1 of the ultimate tip 31 of the cutting member 7 in accordance with the invention is much more robust than the profile P of the basic tip 33, the ultimate tip 31 is stronger than the ultimate tip of the cutting member 7 would be if the profile P extended throughout the tip 27. As a result, the ultimate tip 31 has a comparatively high resistance to wear. As the tip 27 is subject to wear predominantly at the location of the ultimate tip 31, the use of the profile P1 also substantially reduces the wear on the cutting member 7 as a whole. As the cutting forces of the cutting member 7 occur predominantly at the location of the basic tip 33, the more robust profile P1 of the ultimate tip 31 substantially does not adversely affect the magnitude of the cutting forces, which are comparatively small as a result of the comparatively slender profile of the basic tip 33. Because of this, in the case of the cutting member 7 in accordance with the invention, a favorable design of the profile P of the basic tip 33 and the profile P1 of the ultimate tip 31 enables the cutting forces, the wear and the service life of the cutting member 7 to be optimized substantially independently. In the example shown, n1 is approximately 0.57, but the invention also comprises embodiments where n1 has a different value that is smaller than the value of n. In the example shown, R is approximately 0.1 μm and d1 is approximately 0.45 μm, so that a1 is approximately 0.81. The invention, however, also comprises embodiments where the values of R and d1 differ from the values used in this example. The invention comprises, in general, embodiments wherein the value of d1 is smaller than approximately 5 μm and the value of R is smaller than approximately 0.5 μm. A sufficiently robust profile P1 of the ultimate tip 31 is generally obtained if the value of n1 is smaller than approximately 0.65 and if the values of d1 and R are chosen to be such that a1 is larger than approximately 0.8. The value of d1 preferably does not exceed approximately 1 μm, because it has been found that the splitting of hairs at the location of the fracture face is performed predominantly by the part of the tip 27 that is situated within a distance of approximately 1 μm from the cutting edge 9, with wear occurring to a great extent within a distance of approximately 0.5 μm from the cutting edge 9. The profile P1 of the ultimate tip 31 can be produced much more readily if the value of R is smaller than approximately 0.2 μm, because, as will be explained in greater detail hereinafter, the ultimate tip 31 is preferably formed by providing the entire tip 27 with the profile P (P' at the location of the ultimate tip 31) and by providing the profile P1 of the ultimate tip 31 in the profile P, P' by means of, for example, etching or grinding, dependent upon the materials used. As, in this way, R is the depth over which the profile P, P' near the cutting edge 9 must be adapted, the profile P, P' requires less adaptation as R is smaller, as a result of which the producibility and the accuracy of the profile P1 are improved.

In the example shown in FIGS. 3 and 4, where n=0.7, n1=0.57, d1=0.45 μm, and R=0.1 μm, the equation n1=n.d1/(R+d1) is met. As a result, it is achieved that at the location where d=d1 the angles of inclination of the profiles P and P1 are equal, so that the profiles P and P1 blend with each other, i.e. without a kink, at the location where d=d1, in the example shown. As a result, the cutting forces of the cutting member 7 in accordance with the invention are further reduced. It is noted, however, that the invention also comprises embodiments where, at the location where d=d1, the equation n1=n.d1/(R+d1) is not met, so that the profiles of the ultimate tip and the basic tip connect to each other so as to form a kink at the location where d=d1. Such a kink causes an increase of the cutting forces. However, in such embodiments, said equation does not have to be met, so that in designing the profile of the ultimate tip there is greater freedom as regards the determination of the values of a1, n1, d1 and R, i.e. regarding the optimization of the robustness of the ultimate tip and the cutting forces of the tip as a whole. Consequently, in such embodiments where there is a kink between the basic tip and the ultimate tip, generally a greater robustness and smaller cutting forces are achieved as compared to cutting members provided with a basic tip with flat basic facets and an ultimate tip with flat ultimate facets, as disclosed, for example, in EP-B-0 591 339.

As FIGS. 3 and 4 further show, the substrate 19 is provided with a coating 35 that extends over the ultimate tip 31, the basic tip 33, and at least a part of the flat portions of the facet faces 21 and 23, said coating 35 having the above-described profiles P and P1 of, respectively, the basic tip 33 and the ultimate tip 31. In the example shown, the coating 35 comprises DLC (diamond-like carbon) having a substantially higher modulus of elasticity than the steel from which the substrate 19 is made. In the example shown, the coating 35 has a thickness h of approximately 0.2 μm. An intermediate layer 37 comprising substantially Cr is situated between the substrate 19 and the coating 35. Said intermediate layer 37 improves the adhesion of the coating 35 to the steel substrate 19 and has a thickness h' of approximately 50 nm in the example shown. As the material of the coating 35 has a higher modulus of elasticity than the material of the substrate 19, the rigidity of the cutting member 7 near the cutting edge 9 is increased substantially. By virtue thereof, deformations of the tip 27 caused by cutting forces are reduced still further, as a result of which the wear on the cutting member 7 is also further reduced and the service life of the cutting member 7 extended still further. In addition, DLC has a comparatively low coefficient of friction, as a result of which the cutting forces are further reduced. It is noted that the invention also includes embodiments in which the coating comprises a different material having a higher modulus of elasticity than the material of the substrate, or embodiments in which the coating has a different thickness. For example, a coating of amorphous diamond or a coating of a ceramic material. The intermediate layer between the substrate and the coating can also be made of a different material, such as Ti, Nb, Mo or W, or it may be provided in a different layer thickness. In all these alternative embodiments, the coating comprises, like in the embodiment shown in FIGS. 3 and 4, the profiles of the ultimate tip and the basic tip, so that the cutting member has a comparatively high resistance to wear and the cutting forces are comparatively small. Furthermore, the invention also comprises embodiments in which a comparatively thin top layer of a material having a coefficient of friction that is lower than that of the material of the coating 35, such as PTFE, is provided on the coating. It is further noted that the invention also includes embodiments in which the coating, viewed from the cutting edge 9, extends farther than, or not as far as, the coating 35 in the example shown. Preferably, however, the coating extends at least over the ultimate tip 31 and the basic tip 33.

As shown in FIG. 4, the substrate 19 is situated, in the case of the profiles P and P1 and layer thicknesses h and h' used in this example, exclusively in the basic tip 33 and not in the ultimate tip 31. In this example, the layer thicknesses h and h' are substantially constant so that, at locations where, in the basic tip 33, the substrate 19 is present below the coating 35, the substrate 19 has a basic profile $P_B$ which approximates the equation $w=a.(d+R)^n-2.h$. In the example shown, the cutting member 7 is manufactured as follows. The basic profile $P_B$ is provided on the substrate 19 by means of a grinding process. The substrate 19 is subsequently cleaned by means of a sputter-etch process using Ar ions, so that oxides and impurities are removed from the substrate surface. By means of this sputter-etch process, the substrate 19 is also provided with a rounded front edge 39. Subsequently, the substrate 19 is provided with the intermediate layer 37 of Cr by means of a PVD process, wherein Cr ions are launched from a Cr target by means of accelerated Ar ions and deposited on the substrate 19. During the provision of the intermediate layer 37, the sputter-etch process is continued as a result of which the basic profile $P_B$ provided on the substrate 19 is transferred to the intermediate layer 37 as accurately as possible. Subsequently, the intermediate layer 37 is provided with the coating 35 of DLC by means of a CVD process, wherein C atoms are deposited on the substrate 19 from a plasma of $C_2H_2$ gas. The CVD process is plasma-assisted, as a result of which the process temperature can be comparatively low. The profiles P and P1 of the basic tip 33 and the ultimate tip 31 are provided in the course of the CVD process. This is achieved by continuing the sputter-etch process during the CVD process, said desired profiles P and P1 being formed by a suitable combination of a number of process parameters, which are to be empirically determined, such as process pressure, process temperature and process voltage. It is noted that the invention also comprises embodiments in which the profiles P and P1 used and the layer thickness h and h' used are such that the substrate 19 is present both in the basic tip 33 and in a part of the ultimate tip 31. In such embodiments, the substrate 19 preferably has a profile, at the location where, in the ultimate tip 31, the substrate 19 is present below the coating 35, which is blunt in comparison with the basic profile $P_B$. By virtue thereof, in such embodiments, the substrate 19 has a more robust profile at the location of the ultimate tip 31 and the coating 35, as a result of which the coating 35 is supported in a firm and stable manner at the location of the ultimate tip 31 by the substrate 19.

The shaver 1 in accordance with the invention, as shown in FIG. 1, is a manually operated razor. The invention also comprises other types of shavers provided with a cutting member in accordance with the invention as described hereinabove. For example, electric shavers wherein the cutting member and/or another component of the shaver can be driven electrically. FIG. 5 shows, by way of example, a second embodiment of a shaver 41 in accordance with the invention. Said shaver 41 comprises a housing 43 on which a second embodiment of a shaving head 45 in accordance with the invention is detachably secured by means of securing means 47 which are only diagrammatically shown in FIG. 5 for the sake of simplicity. The housing 43 accommodates an electric motor 49, a battery 51 for feeding the motor 49 and an electric control member 53 for controlling the motor 49. The motor 49 can be switched on and off by means of a switch 55 provided on the housing 43. A cutting member 57 in accordance with the invention and a hair manipulator 59 co-operating with said cutting member 57 are arranged in the shaving head 45. The cutting member 57 is arranged in the shaving head 45 in a fixed position and comprises a plate-shaped, steel substrate 61 on which a tip 63 is provided which is bounded by a cutting edge 65. The tip 63 comprises a basic tip and an ultimate tip with profiles as described hereinabove. The substrate 61 is attached to a plate-shaped support 67 which is secured in the shaving head 45 in a fixed position. The hair manipulator 59 comprises a support 69, which is also plate-shaped, on which a plurality of teeth 71 are provided. Said teeth 71 are situated, viewed in the shaving direction X of the shaving head 45, directly in front of the cutting edge 65 of the cutting member 57. The support 69 is coupled to an outgoing shaft 75 of the motor 49 by means of an eccentric transmission 73, so that the hair manipulator 59 can be driven by means of the motor 49 in accordance with a reciprocating movement in a Y-direction parallel to the cutting edge 65. If, in operation, the shaving head 45 is displaced over the skin 77 in the shaving direction X, the hairs 79 are first caught between the teeth 71 of the hair manipulator 59. As a result, the hairs 79 are reciprocated, directly before and during cutting, along the cutting edge 65 by means of the hair manipulator 59, which leads to a substantial reduction of the cutting forces necessary to cut the hairs 79. In another feasible embodiment of a shaver in accordance with the invention, the cutting member is driven by means of a drive mechanism. Said drive mechanism causing, for example, a high-frequency or ultrasonic movement of comparatively small amplitude.

In the above-described cutting member 7 in accordance with the invention, the profiles P and P1 of the basic tip 33 and the ultimate tip 31 approximate, respectively, the equations $w=a.(d+R)^n$ and $w=a1.d^{n1}$. It is noted that the invention comprises cutting members wherein said profiles at least approximate said functions, i.e. approximate said functions or follow said functions exactly or substantially exactly. The verb "to approximate" and its conjugations are to be understood to mean herein "approach as closely as the applied manufacturing processes permit".

It is further noted that the invention also includes embodiments of a cutting member which are not provided with a coating. In such embodiments, the profiles of the basic tip and the ultimate tip are provided in the surface of the substrate of the cutting member.

It is finally noted that the invention also includes embodiments of a cutting member which are provided with a tip that is asymmetrically provided with respect to the imaginary center plane of the substrate. An example thereof is formed by cutting members ground on one side, which are provided, near the cutting edge, with only a single facet face.

What is claimed is:

1. A cutting member comprising a plate-shaped substrate on which a tip is provided which is bounded by a cutting edge, which tip, viewed in an imaginary plane extending perpendicularly to the cutting edge, has a profile that at least approximates the equation $w=a.d^n$, where w is a profile thickness (in $\mu$m), viewed in a direction perpendicular to a bisecting line of the tip, and d is a distance (in $\mu$m) up to the cutting edge, viewed in a direction parallel to the bisecting line, and a is smaller than approximately 0.8 and n is smaller than approximately 0.75 and greater than approximately 0.65, characterized in that the tip comprises an ultimate tip and a basic tip, which ultimate tip extends from the cutting edge over a distance d1 and has a profile that at least approximates the equation $w=a1.d^{n1}$, while the basic tip connects to the ultimate tip and has a profile that at least approximates the equation $w=a.(d+R)^n$, where d1 is smaller than approximately 5 $\mu$m, R is smaller than approximately 0.5 $\mu$m, n1 is smaller than n, and $a1=a.(d1+R)^n/d1^{n1}$.

2. A cutting member as claimed in claim 1, characterized in that $n1=n.d1/(R+d1)$.

3. A cutting member as claimed in claim 1, characterized in that al is greater than approximately 0.8 and n1 is smaller than approximately 0.65.

4. A cutting member as claimed in claim 1, characterized in that d1 is smaller than approximately 1 $\mu$m.

5. A cutting member as claimed in claim 1, characterized in that R is smaller than approximately 0.2 $\mu$m.

6. A cutting member as claimed in claim 1, characterized in that the ultimate tip and the basic tip are provided with a coating of a material having a higher modulus of elasticity than the material used to manufacture the substrate, with the coating having said profiles of the ultimate tip and the basic tip.

7. A cutting member as claimed in claim 6, characterized in that, at the location where in the basic tip the substrate is present below the coating, the substrate has a basic profile that at least approximates the equation $w=a.(d+R)^n-2h$, where h is a thickness of the coating, and in that, at the location where in the ultimate tip the substrate is present below the coating, the substrate has a profile that is blunt in comparison with the basic profile.

8. A cutting member as claimed in claim 6, characterized in that the material of the coating comprises DLC (diamond-like carbon).

9. A cutting member as claimed in claim 8, characterized in that an intermediate layer comprising Cr is provided between the coating and the substrate.

10. A shaving head comprising a holder in which at least one cutting member is provided, wherein the cutting member is a cutting member as claimed in claim 1.

11. A shaver comprising a housing or handgrip on which a shaving head is provided, wherein the shaving head is a shaving head as claimed in claim 10.

* * * * *